United States Patent [19]

O'Brien

[11] 3,935,782

[45] Feb. 3, 1976

[54] END PLUG ADAPTER

[75] Inventor: Paul J. O'Brien, Long Beach, Calif.

[73] Assignee: Barcus-Berry, Inc., Long Beach, Calif.

[22] Filed: Dec. 9, 1974

[21] Appl. No.: 531,153

[52] U.S. Cl. ..... 84/1.16; 84/267; 84/327

[51] Int. Cl.² ..... G10H 3/00; G10D 1/08

[58] Field of Search ..... 84/1.14, 1.16, 267, 327

[56] References Cited

UNITED STATES PATENTS

| | | | |
|---|---|---|---|
| 3,035,472 | 5/1962 | Freeman | 84/1.16 |
| 3,080,785 | 3/1963 | Evans | 84/267 |
| 3,237,502 | 3/1966 | Moseley | 84/267 |
| 3,465,086 | 9/1969 | Bokell | 84/1.16 |
| 3,712,951 | 1/1973 | Rickard | 84/1.16 |

*Primary Examiner*—L. T. Hix
*Assistant Examiner*—Vit W. Miska
*Attorney, Agent, or Firm*—Albert L. Gabriel

[57] ABSTRACT

A rigid end plug adapter which serves both as a strap or end button and electrical connector for transducer pickups is provided in the end block of a musical instrument such as a guitar or violin-type instrument.

7 Claims, 4 Drawing Figures

FIG. 1
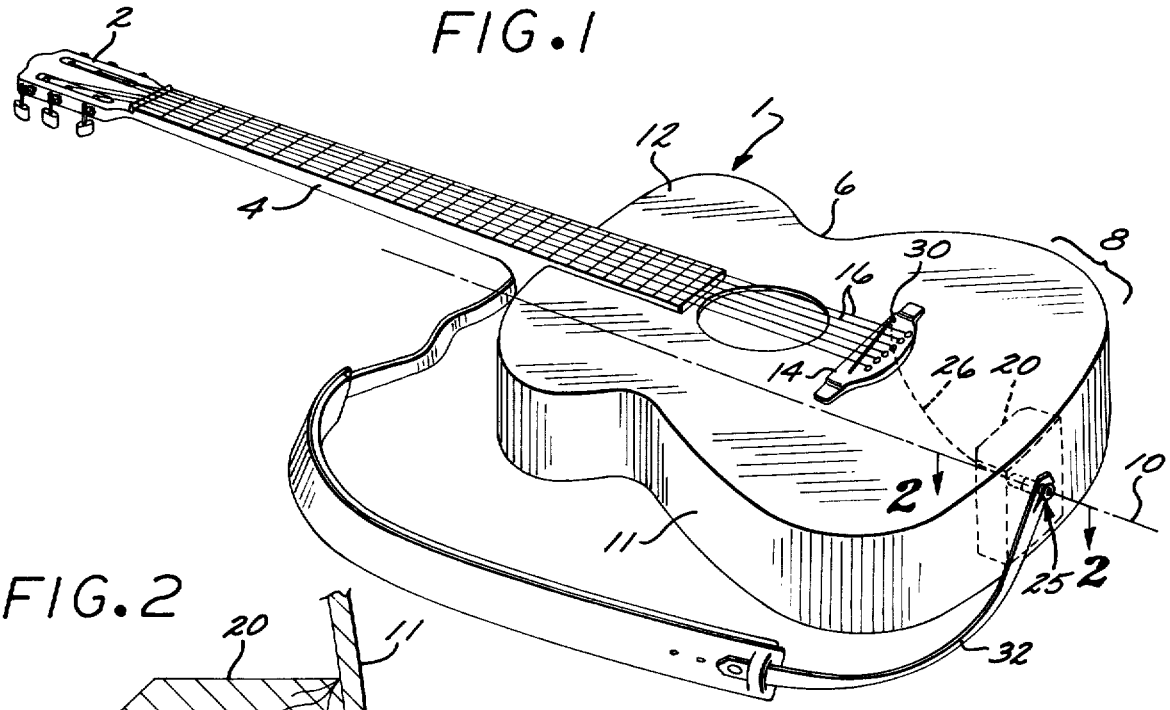
FIG. 2
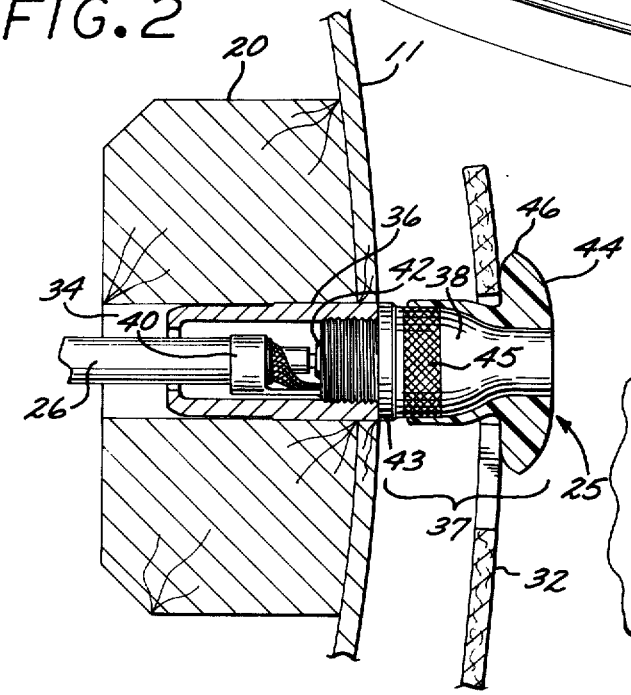
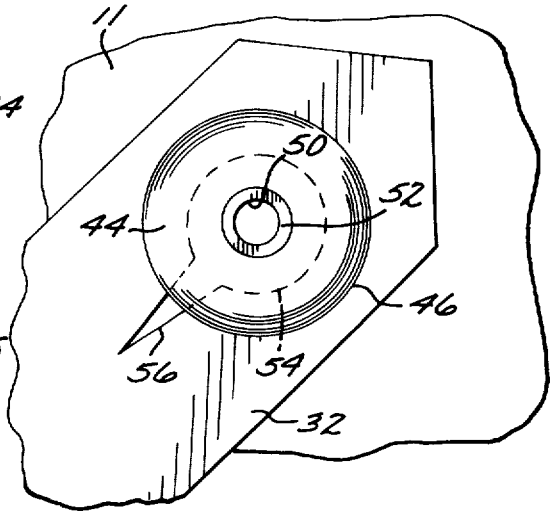
FIG. 3
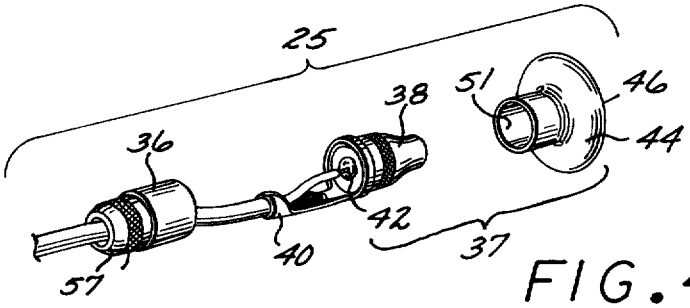
FIG. 4

END PLUG ADAPTER

BACKGROUND OF THE INVENTION

1. Field of the Invention

The invention is in the field of end plug adapters for musical instruments.

2. Description of the Prior Art

It is traditional in the musical world to incorporate a strap button within the end block of guitars and the like to serve as a mounting post for a shoulder strap. In the case of violins and similar instruments, an end button is utilized to provide a means for anchoring the strings which are fixed at the tuning head and tensioned over the instrument bridge. The term "end plug" as employed herein as hereby defined to include both the strap buttons of guitars or other instruments utilizing a strap, and the end buttons of violin-type instruments. In the prior art, the end plugs of guitars and the like and of violintype instruments have generally been wood or plastic members force-fit into holes drilled in the instrument end block. These wood or plastic members are often under considerable stress and are subject to breakage.

With the advent of small economical transducers such as those manufactured and sold by Barcus-Berry, Inc., Long Beach, California, the problem of coupling these pickups from the musical instrument to amplifying equipment has become important. Prior art methods of coupling comprise drilling a large hole through the rib portion of these instruments and having electrical conductors, which may include an electrical connector mounted in the rib, extend from the transducer pickups through the hole for connection to amplifying equipment. Although such an arrangement may be suitable for inexpensive guitars, one is usually not willing to drill a ¼ inch diameter hole through the rib of an expensive instrument such as a Stradivarius. Thus, in expensive instruments where the intrinsic value of the instrument would be greatly reduced with the drilling of any holes in the rib section, internal electrical wiring for transducer pickups would be virtually precluded.

In mounting an electrical connector in the rib of a musical instrument there is also the danger of seriously damaging the instrument if the external lead wire is suddenly brought under tension as by tripping over or catching the usually long cord to the amplifying equipment. If the connector is rigidly mounted in the rib member, a sudden pull on the external cord could well rip out a large section of the rib rendering the instrument useless.

SUMMARY OF THE INVENTION

It is an object of the invention to provide an electrical connector for musical instruments which will not reduce the intrinsic or aesthetic value of the instrument.

It is another object of the invention to provide an end plug adapter for a musical instrument which is more rigid and desirable than prior art end plugs and yet is serviceable as an electrical connector, strap button, and/or end button.

A further object of the invention is to provide a rigid, inexpensive and easily installed end plug adapter, serving both as a strap or end button and electrical connector utilizing a single hole in the end block of the musical instrument.

The invention pertains to an end plug adapter in musical instruments having an end block such as a violin-type instrument, guitar and the like. The adapter is positioned in the conventional position of an end plug, but comprises both electrical connector members and a cap member having an aperture therethrough. The connector comprises an easy connect/disconnect electrical connector for connecting transducers to remote amplifying equipment, while the cap member is secured to the exposed section of the connector for providing a flared section to secure a strap or string anchor.

BRIEF DESCRIPTION OF THE DRAWINGS

Other objects of the invention will be apparent in reference to the preferred embodiment discussed hereinafter wherein:

FIG. 1 is a perspective view of a guitar showing the adapter mounted therein;

FIG. 2 is an axial sectional view of the adapter taken along line 2—2 of FIG. 1, with portions shown in elevation;

FIG. 3 is a partial end view of the adapter of FIG. 1; and

FIG. 4 is an exploded view of the adapter showing components thereof.

DETAILED DESCRIPTION OF THE PREFERRED EMBODIMENT

The adapter may readily be incorporated in a guitar such as that shown in FIG. 1. The description with regard to a guitar is merely exemplary and it is understood that other instruments may equally well be equipped with the adapter. Guitar 1 comprises a tuning head 2, neck 4 and a body section 6. The body section 6 has a lower or foot portion 8 and the body 6 is generally shaped to have a symmetry or longitudinal axis 10. The body section 6 comprises a rib section 11 around the periphery thereof, and a face 12 having a bridge 14 mounted thereon. The bridge is utilized to support the strings 16 and to provide a coupling to the resonant body section 6. Within the foot portion 8 of the body section 6 is an end block 20 having an adapter 25 mounted therein. A coaxial cable 26 is connected from the adapter 25 to an electronic guitar pickup member 30. The guitar pickup member 30 may be similar to the "Hot-Dot" manufactured by Barcus-Berry, Inc., Long Beach, California. Additionally, two such guitar pickups may be used in which case the leads from the pickups are wired in parallel. A strap 32 is shown connected to the adapter 25.

A detailed view of the adapter is shown in FIG. 2 wherein the end block 20 contains an aperture 34 therethrough. FIG. 2 shows a coaxial cable 26 connected to the adapter 25. Adapter 25 comprises a first threaded cylindrical member 36 and an end plug portion 37 which comprises a second threaded receptacle connector member 38. Both the first and second threaded members are readily available from Switchcraft, Inc., 5555 North Elston Avenue, Chicago, Illinois, and are the sleeve portions of a jack assembly identified as "Jack No. 125." The receptacle member 38 has a clamp portion 40 connected thereto, and electrically isolated from an internal connector portion 42. Both the clamp 40 and the internal connector portion 42 are integrally a part of the receptacle member 38. Receptacle member 38 has a rib section 43 which fits flush against rib 11 when the receptacle member 38 is tightened into the cylindrical member 36. Cylindrical member 36 is force-fit into the ⅜ inch aperture 34. The receptacle member 38 has a knurl section 45 over which a cap 44 is pressure fitted. Cap 44 is made of a resilient plastic, and has a flared lip section 46 as shown. Both member 38 and cap 44 comprise the end plug section 37 of the adapter 25.

The receptacle member 38 has an adapter 50 therein and cap 44 surrounds the outer section of receptacle member 38 and also has an aperture 51 completely therethrough so as to leave aperture 50 completely unobstructed. As shown in FIG. 3, the cap 44 completely surrounds the receptacle member 38 and fits flush against an end 52 of member 38. The aperture 50 in receptacle 38 is adapted to receive a mating plug connector portion of the jack assembly (not shown) for connecting the cable 36 to the speaker system.

The strap 32 has an aperture 54 and a contiguous slot 56 adjacent thereto. The strap 32 may then be easily pressed over the flared lip section 44 and secured between the lip 44 and the instrument rib 11.

FIG. 4 shows an exploded view of the adapter showing the threaded cylindrical member 36, receptacle member 38 and cap portion 44. The cylindrical member 36 includes a tapered lead-in section 57 which facilitates entry thereof into the aperture 34, and a knurled section 58 which assures good retention thereof in the aperture 34.

The threaded cylindrical member 36 is pressure-fitted into the end block 20 and provides a much more rigid and reliable connector than prior art rib connectors. In addition, the position of the adapter within the end block and in the same position as the conventional strap button enhances the intrinsic value of the guitar in that no additional electrical connector holes need be made in the rib or body section of the guitar. In addition, the strap button function is not sacrificed as the cap 44 is shaped with lip section 46 so as to engage a strap connected thereto. The lip section 46 and receptacle member 38 also serve as an anchor support in the case of a guitar and similar instruments. With an adapter according to the invention made of metal, it is intrinsically stronger than conventional wood or plastic end plugs, thereby enhancing the strap button and string anchor button functions in strength.

The adapter is positioned along an axis parallel to the longitudinal axis of the guitar and is generally positioned along the symmetry axis of the body section 6.

In installing the adapter 25, the factory-installed wooden or plastic end plug is removed and the recess in the end block 20 is extended to form the aperture 34. The adapter is connected to the lead wires (usually coaxial cables) which are brought out through the aperture 34, and the adapter is then pressure-fitted into the end block.

The overall length of the receptacle member 38 which is exposed, once the receptacle member 38 is securely tightened into connector 36, is no longer than traditional end plug dimensions so that the guitar itself may readily fit into a case without disconnection of the receptacle member 38.

While the invention has been described with reference to the above disclosure relating to the preferred embodiments, it is understood the numerous modifications or alterations may be made by those skilled in the art without departing from the scope and spirit of the invention as set forth in the claims.

I claim:

1. In a stringed musical instrument adaptable for having an electronic pickup transducer connected thereto, said instrument having a rib member and a body section with a foot portion having an end block therein, the improvement comprising:

an elongated tubular body extending through said rib member and into said end block, said body being oriented substantially parallel to the longitudinal axis of the instrument, electrical connector means disposed within said body for connection to said pickup, and said tubular body including end plug means for securing an instrument support strap, said end plug means projecting outwardly of said rib and substantially parallel to said longitudinal axis of said instrument.

2. Apparatus as recited in claim 1 wherein said end plug means has a flared lip portion.

3. Apparatus as recited in claim 1 wherein said end plug means comprises:

an electrical receptacle member having an aperture therein for receiving plug means, and resilient cap means mounted around said receptacle member and having an aperture therethrough concentric with the aperture of said receptacle member.

4. Apparatus as recited in claim 1 wherein said electrical connector means comprises receptacle connector means for receiving plug means.

5. Apparatus as recited in claim 2 wherein said flared lip portion comprises a generally annular member separable from said electrical connector means.

6. Apparatus as recited in claim 3 wherein said electrical receptacle member has a knurled section and said cap means resiliently surrounds said knurled section.

7. A method of mounting an adapter having an electrical connector member on a stringed musical instrument having an end block and adaptable for having an electronic pickup transducer mounted thereto, said method comprising the steps of:

drilling an aperture completely through the end block of said instrument along the longitudinal axis of said instrument, connecting lead wires from said pickup transducer to said adapter, pressure-fitting said adapter into said aperture of said end block, and pressure-fitting a flared instrument strap support member onto said electrical connector member.

* * * * *